US007639111B2

(12) United States Patent
Hsu et al.

(10) Patent No.: US 7,639,111 B2
(45) Date of Patent: Dec. 29, 2009

(54) HIGH VOLTAGE TRANSFORMER FOR BACKLIGHT POWER SOURCE

(75) Inventors: Cheng Chia Hsu, Chupei (TW); Teng Kang Chang, Jhudong Township, Hsinchu County (TW)

(73) Assignee: Logah Technology Corp., Hsinchu (TW)

( * ) Notice: Subject to any disclaimer, the term of this patent is extended or adjusted under 35 U.S.C. 154(b) by 172 days.

(21) Appl. No.: 12/022,991

(22) Filed: Jan. 30, 2008

(65) Prior Publication Data

US 2008/0116822 A1 May 22, 2008

Related U.S. Application Data

(63) Continuation-in-part of application No. 11/187,842, filed on Jul. 25, 2005, now abandoned.

(51) Int. Cl.
*H01F 27/24* (2006.01)

(52) U.S. Cl. ..... 336/192; 336/198; 336/208

(58) Field of Classification Search ..... 315/276, 315/277, 278, 279, 281; 336/192, 198, 208
See application file for complete search history.

(56) References Cited

U.S. PATENT DOCUMENTS 6,661,326 B2 * 12/2003 Yeh et al. ..... 336/208
6,734,777 B2 * 5/2004 Yeh et al. ..... 336/208

* cited by examiner

*Primary Examiner*—David Hung Vu
(74) *Attorney, Agent, or Firm*—Chun-Ming Shih

(57) ABSTRACT

A high voltage transformer for a backlight power source includes a windings base, a core and windings, the windings base having isolating walls disposed exterior thereto through which a primary side region and a secondary side region are formed, the secondary side region being optionally formed with several windings troughs by using of the isolating walls and the windings being wound on the windings troughs, the windings being wound upward layer by layer on a bottom of the windings trough when the windings are wound across the isolating walls in prevention of the windings of different voltages flown therein crossing and contacting with each other and fixed onto a windings fixation post after the windings troughs are full, and the core being received within a hollow structure of the windings base. As such, distance generated from stacking of the windings is served to increase the bearing voltage and reduce length of the transformer.

6 Claims, 9 Drawing Sheets

HIGH VOLTAGE TRANSFORMER FOR BACKLIGHT POWER SOURCE

RELATED APPLICATIONS

This application is a continuation-in-part of U.S. patent application Ser. No. 11/187,842, filed on Jul. 25, 2005 now abandoned.

BACKGROUND OF THE INVENTION

1. Field of the Invention

The present invention relates to a high voltage transformer for a backlight power source, and more particularly to a high voltage transformer for a backlight power source in which windings may be wound upward layer by layer on a bottom of a windings trough, which is facilitated by a novel structural design of a windings base when the windings are wound across an isolating wall so that a voltage bearing ability and stability of the high voltage transformer is enhanced.

2. Description of the Related Art

FIGS. 1A, 1B and 1C are respectively a side view, partial view and partial side view of a conventional transformer. As shown, the transformer 1 is composed of a windings base 11, a core 12 and windings 13. Exterior to the windings base 11, a plurality of isolating walls 111 are disposed, through which a primary side region 14 and a secondary side region 15 are formed. Through the isolating walls 111, the secondary side region 15 is further divided into a multitude of windings troughs 16 in which the windings 13 are disposed in turn.

Within a hollow structure of the windings base 11, the core 12 is received. As such, formation of the transformer 1 is completed. Since the transformer 1 has to meet the requirement of voltage bearing, the plurality of troughs are provided to isolate the voltage. However, since the isolating walls 111 are too high and thin (typically 0.4 mm in thickness), distance between two such adjacent troughs 16 is insufficient, leading to an insufficient voltage bearing ability of the troughs 16. On the other hand, when the coil of the windings 13 is intended to be laid out through a cutout opening 112 onto another windings trough 16, the coil strides from the top to the bottom through the isolating wall 111. This causes windings 13 wound on the next trough 16 in contact with the stridden coil and causes windings 13 of different voltages flown therein to interfere to each other and thus the voltage bearing ability is reduced. In this case, characteristics of the transformer 1 are unstable and exception would generally occur. In response to this problem, more windings troughs are generally suggested. However, issues of cost, dimension and layout space may be additionally involved in this design.

U.S. Pat. No. 6,937,129 of Hsuch et al. discloses a transformer with different coil winding densities. The flanges 313 shown in FIG. 3*a* include the cutout openings for the coils 312*a* and 312*b* to pass through. However, Hsuch does not teach or suggest to prevent the stridden coil from contacting the wound windings.

U.S. Pat. No. 6,936,379 of Kondo discloses a coil device which is provided with a plurality of winding drums on a bobbin with a partition formed between flanges at both ends of the bobbin. Although the slit 7 has a corner 7*a* shown in FIG. 1 or an one-side radiused portion 7*b* shown in FIG. 5, Kondo still does not teach or suggest to prevent the stridden wire "w" from contacting the wound windings.

From the above discussion, it can be readily known that such conventional transformer is inherent with some drawbacks and needs to be addressed and improved.

In view of these problems encountered in the prior art, the Inventors have paid many efforts in the related research and finally developed successfully a high voltage transformer for a backlight power source, which is taken as the present invention.

SUMMARY OF THE INVENTION

Therefore, the present invention is to provide a high voltage transformer for a backlight power source in which windings can be wound upward layer by layer on a bottom of a windings trough, which is facilitated by a novel structural design of a windings base, when the windings are wound across an isolating wall, in prevention of windings of different voltages flown therein crossing and contacting with each other and thus a reduced voltage bearing ability of the transformer.

Another, the present invention is to provide a high voltage transformer for a backlight power source in which distance generated from stacking of the windings is served to increase the bearing voltage and reduce length of the transformer, enhancing stability of the transformer.

Still another, the present invention is to provide a high voltage transformer for a backlight power source having the advantages of prolonged lifetime, lower cost, reduced dimension and space saving of the transformer.

The high voltage transformer for a backlight power source according to the present invention is composed of a windings base, a core and windings. Exterior to the windings base, isolating walls are disposed, through which a primary side region and a secondary side region are formed. In the secondary side region, the isolating walls may be optionally utilized to form several windings troughs on which the windings are wound. Within a hollow structure of the windings base, the core is disposed. With the novel structural design of the windings base, when the windings are wound across the isolating wall, the windings may be wound upward layer by layer on a bottom of the windings trough in prevention of windings of different voltages flown therein crossing and contacting with each other and thus the reduced voltage bearing ability of the transformer.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1A:
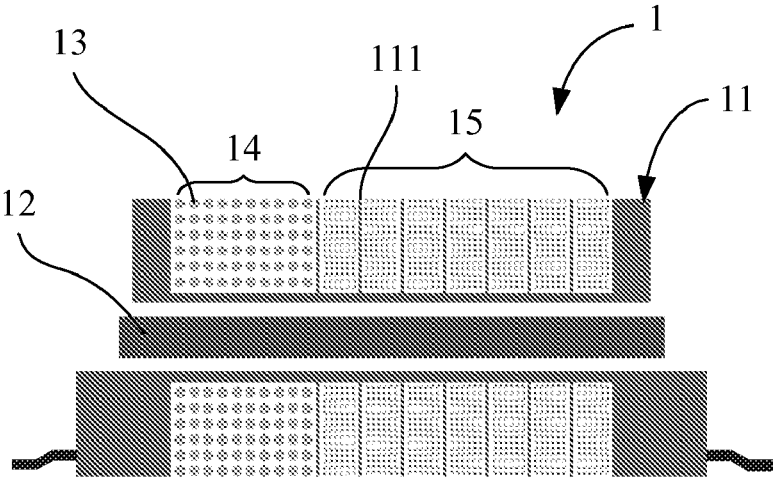
FIG.1 A Prior Art
FIG. 1A is a side view of a conventional transformer.
Figure 1B:
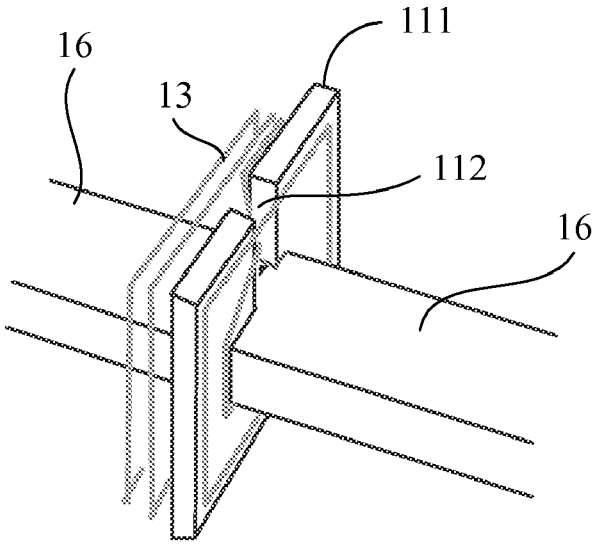
FIG.1 B Prior Art
FIG. 1B is a partial view of the conventional transformer.
Figure 1C:
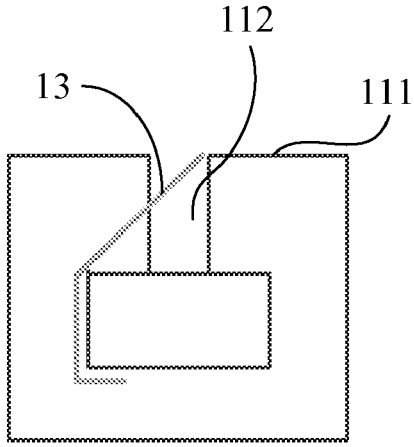
FIG.1 C Prior Art
FIG. 1C is a partial side view of the conventional transformer.
Figure 2A:
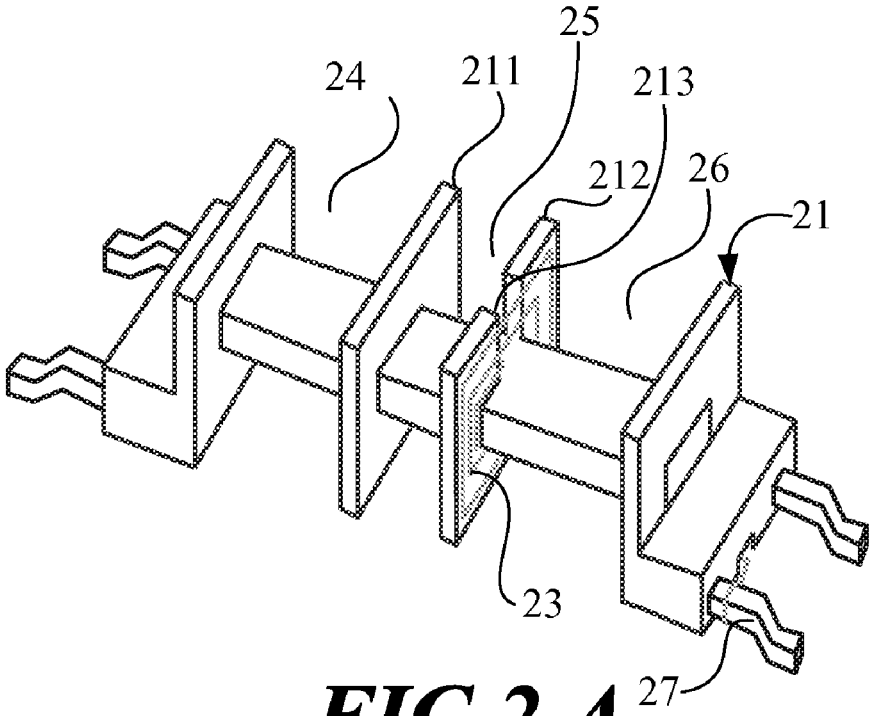
FIG. 2A is a perspective view of a high voltage transformer for a backlight power source according to a first embodiment of the present invention.
Figure 2B:
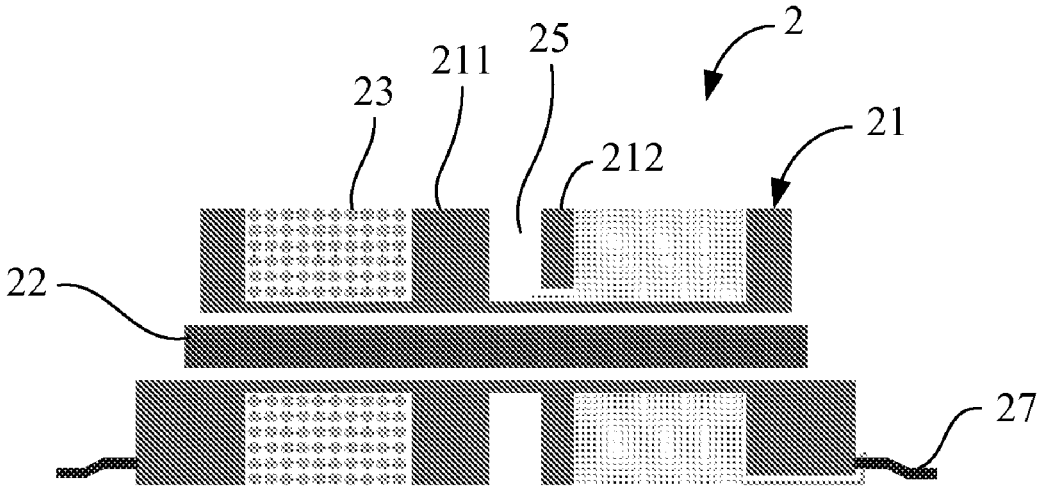
FIG. 2B is a side view of the high voltage transformer for a backlight power source according to the first embodiment of the present invention.

Referring to FIGS. 2A and 2B, a perspective view and side view of a windings base of a high voltage transformer for a backlight power source according to a first embodiment of the present invention are illustrated, respectively. As shown, exterior to the windings base 21, isolating walls 211, 212 are disposed, through which a first windings trough 24, a spare trough 25 and a second windings trough 26 are formed. In laying out the windings 23, the windings 23 are wound first on a bottom of the first windings trough 24 at a primary side region and then stridden on the spare trough 25 after the first windings trough 24 is full. Then, the windings 23 are guided onto the second windings trough 26 at a secondary side region through a cutout opening 213 formed on the isolating wall 212. Thereafter, the windings 23 are wound upward on a bottom of the second windings trough 26 layer by layer until the second windings trough 26 is full. Finally, the windings 23 are fixed onto a windings fixation post 27. As such, the windings 23 of different voltages flown therein may be prevented from crossing and contacting with each other when being wound from one trough to an adjacent trough. Then, the core 22 is disposed within a hollow structure of the windings base 21 and the high voltage transformer 2 is thus completely formed.

Figure 3A:
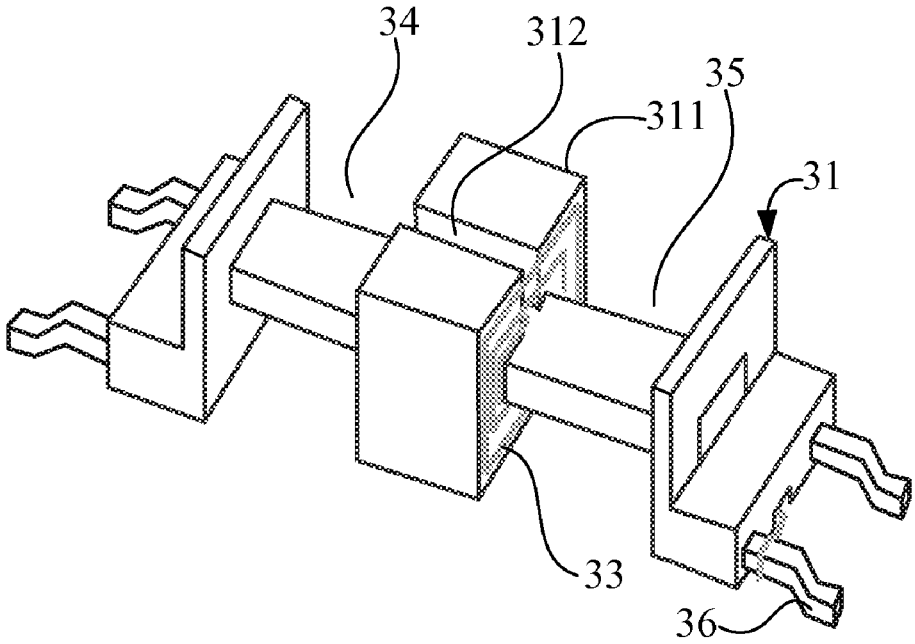
FIG. 3A is a perspective view of the high voltage transformer for a backlight power source according to a second embodiment of the present invention.
Figure 3B:
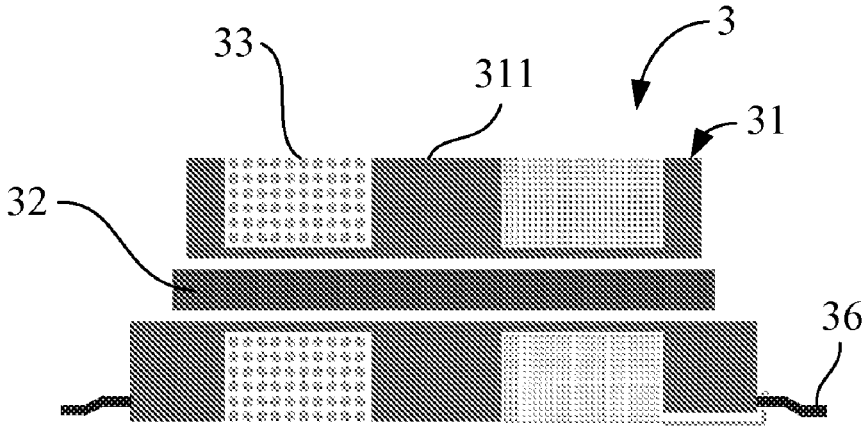
FIG. 3B is a side view of the high voltage transformer for a backlight power source according to the second embodiment of the present invention.

Referring to FIGS. 3A and 3B, a perspective view and side view of a windings base of the high voltage transformer for a backlight power source according to a second embodiment of the present invention are illustrated, respectively. As shown, the transformer 3 is composed of a windings base 31, a core 32 and windings 33. Exterior to the windings base 31, a thick isolating wall 311 is disposed, through which a first windings trough 34 and a second windings trough 35 are formed. In laying out the windings 33, the windings 33 are wound first on a bottom of the first windings trough 34 at a primary side region and then stridden onto the second windings trough 35 at a secondary side region through a recess 312 formed on the thick isolating wall 311. Thereafter, the windings 33 are wound upward on a bottom of the second windings trough 35 layer by layer until the second windings trough 35 is full. Finally, the windings 33 are fixed onto a windings fixation post 36. As such, the windings 33 of different voltages flown therein may be prevented from crossing and contacting with each other when being wound from one trough to an adjacent trough. Then, the core 32 is disposed within a hollow structure of the windings base 31 and the high voltage transformer 2 is thus completely formed.

Figure 4A:
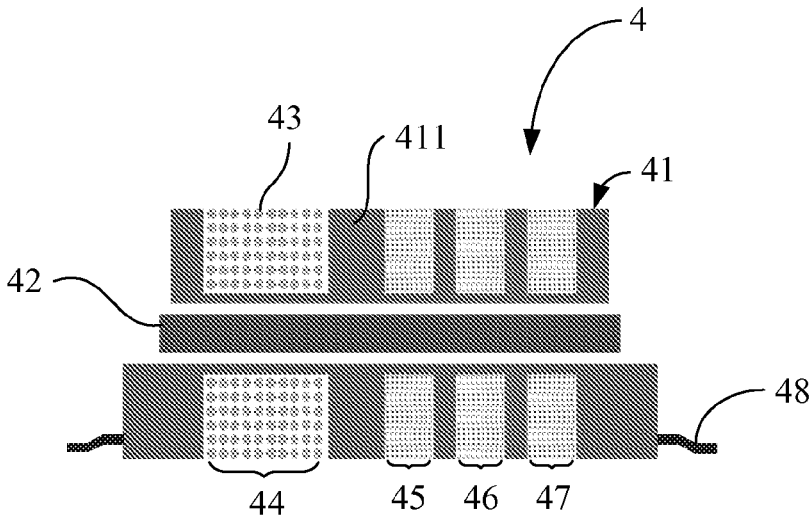
FIG. 4A is a side view of the high voltage transformer for a backlight power source according to a third embodiment of the present invention.
Figure 4B:
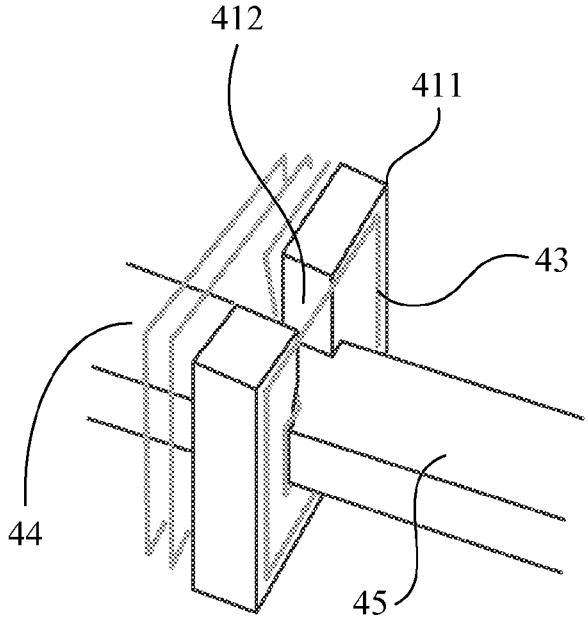
FIG. 4B is a partial view of the high voltage transformer for a backlight power source according to the third embodiment of the present invention.
Figure 4C:
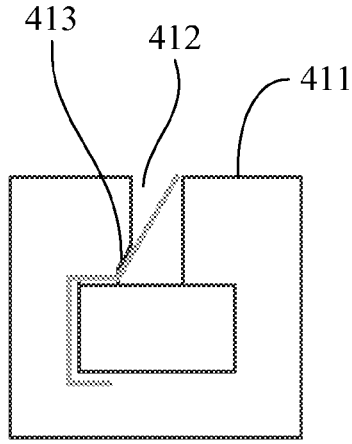
FIG. 4C is a partial side view of the high voltage transformer for a backlight power source according to the third embodiment of the present invention.

Referring to FIGS. 4A, 4B and 4C, a side view, partial view and partial side view of the high voltage transformer for a backlight power source according to a second embodiment of the present invention are illustrated, respectively. As shown, the transformer 4 is composed of a windings base 41, a core 42 and windings 43. Exterior to the windings base 41, a plurality of isolating walls 411 are disposed, on each of which a cutout opening 412 having a guiding recess 413 formed at a bottom corner of an inner wall of the cutout opening 413. With provision of the isolating walls 411, a first windings trough 44 at a primary side region and a second windings trough 45, a third windings trough 46 and a fourth windings trough 47 at a secondary side region are separated from one another. In laying out the windings 43, the windings 43 are wound first on a bottom of the first windings trough 44 at a primary side region and then stridden onto the second windings trough 45 at a secondary side region through the opening 412 formed on the thick isolating wall 411 after the first windings trough 44 is full. A coil of the windings 43 is guided onto a bottom of the second windings trough 45 through the guiding recess 413 of the opening 412 and then wound layer by layer until the second, third and fourth windings trough 45, 46, 47 are all full. Finally, the windings 43 are fixed onto a windings fixation post 48. As such, the windings 43 of different voltages flown therein may be prevented from crossing and contacting with each other when being wound from one trough to an adjacent trough. Then, the core 42 is disposed within a hollow structure of the windings base 41 and the high voltage transformer 4 is thus completely formed.

Figure 5A:
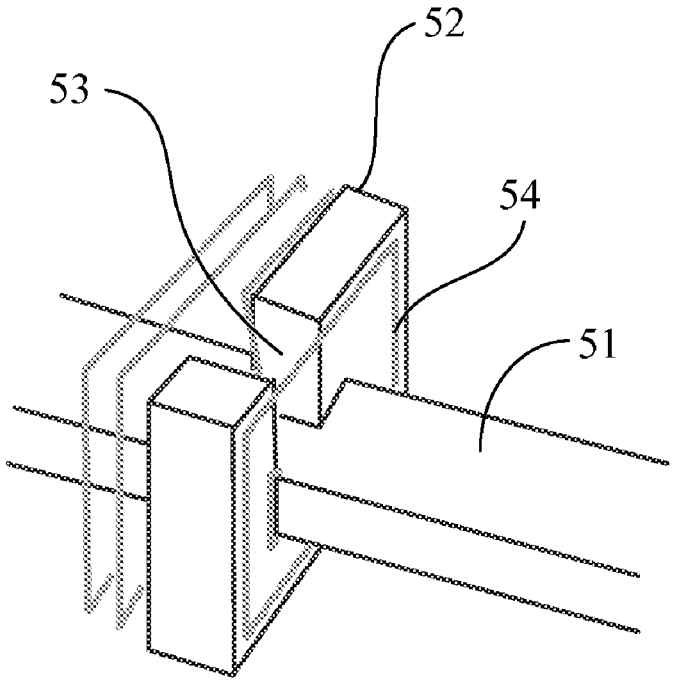
FIG. 5A is a partial view of the high voltage transformer for a backlight power source according to a fourth embodiment of the present invention.
Figure 5B:
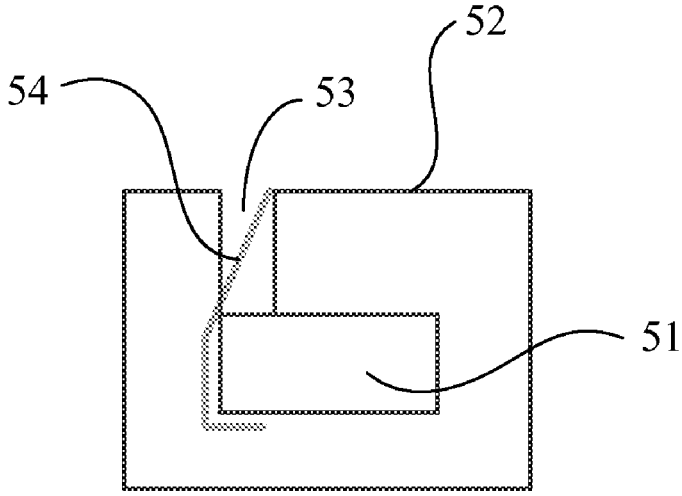
FIG. 5B is a partial side view of the high voltage transformer for a backlight power source according to the fourth embodiment of the present invention.

Referring to FIGS. 5A and 5B, a partial view, partial side view of the high voltage transformer for a backlight power source according to a fourth embodiment of the present invention are illustrated, respectively. As shown, a recess 53 is disposed at a position deviated from a main shaft body 51 on an isolating wall 53 of the transformer 5. In this case, windings 54 may not cross and contact with each other when being wound from one trough to an adjacent trough through the recess 53.

Figure 6A:
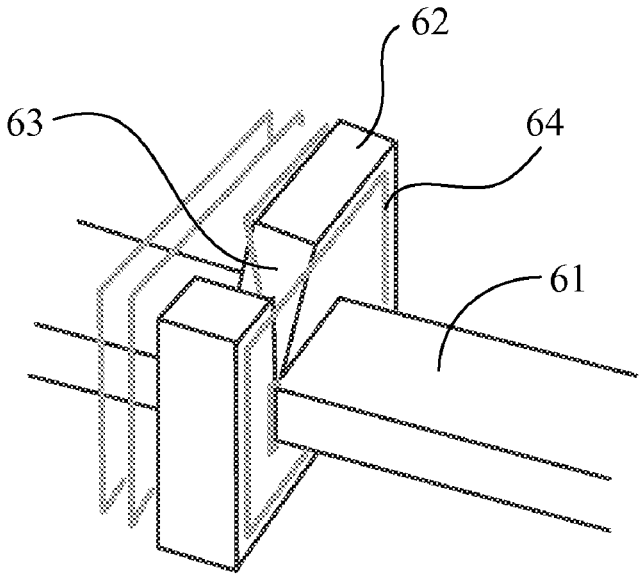
FIG. 6A is a partial view of the high voltage transformer for a backlight power source according to a fifth embodiment of the present invention.
Figure 6B:
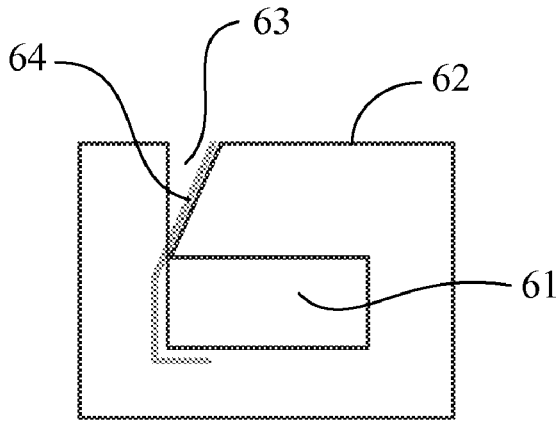
FIG. 6B is a partial side view of the high voltage transformer for a backlight power source according to the fifth embodiment of the present invention.

Referring to FIGS. 6A and 6B, a partial view, partial side view of the high voltage transformer for a backlight power source according to a fifth embodiment of the present invention are shown, respectively, therein. As shown, a recess 63 having a slanting surface is disposed at a position deviated from a main shaft body 61 on an isolating wall 63 of the transformer 6. In this case, windings 64 may not cross and contact with each other when being wound from one trough to an adjacent trough through the recess 63.

Figure 7A:
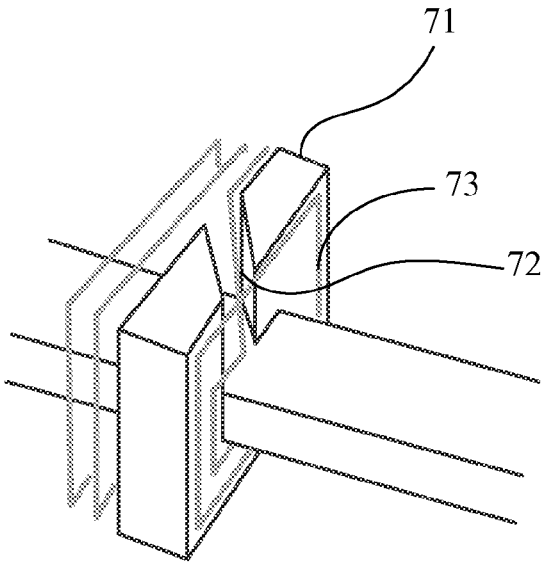
FIG. 7A is a partial view of the high voltage transformer for a backlight power source according to a sixth embodiment of the present invention.
Figure 7B:
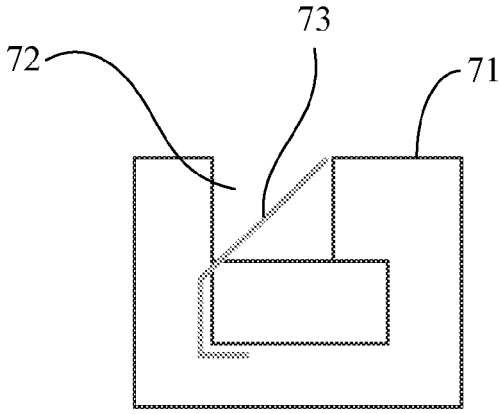
FIG. 7B is a partial side view of the high voltage transformer for a backlight power source according to the sixth embodiment of the present invention.

Referring to FIGS. 7A and 7B, a partial view, partial side view of the high voltage transformer for a backlight power source according to a sixth embodiment of the present invention are illustrated, respectively. As shown, a slantedly disposed recess 72 is disposed on an isolating wall 71. In this case, windings 73 may not cross and contact with each other when being wound from one trough to an adjacent trough through the slantedly disposed recess 72.

Figure 8:
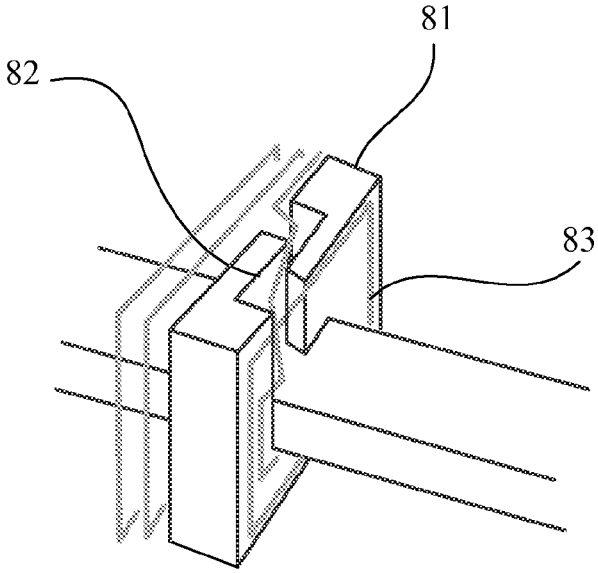
FIG. 8 is a partial view of the high voltage transformer for a backlight power source according to a seventh embodiment of the present invention.

Referring to FIGS. 8A and 8B, a partial view, partial side view of the high voltage transformer for a backlight power source according to a seventh embodiment of the present invention are illustrated, respectively. As shown, a two-sectioned recess 82 is disposed on an isolating wall 81. In this case, windings 83 may not cross and contact with each other when being wound from one trough to an adjacent trough through the two-section recess 82.

Figure 9A:
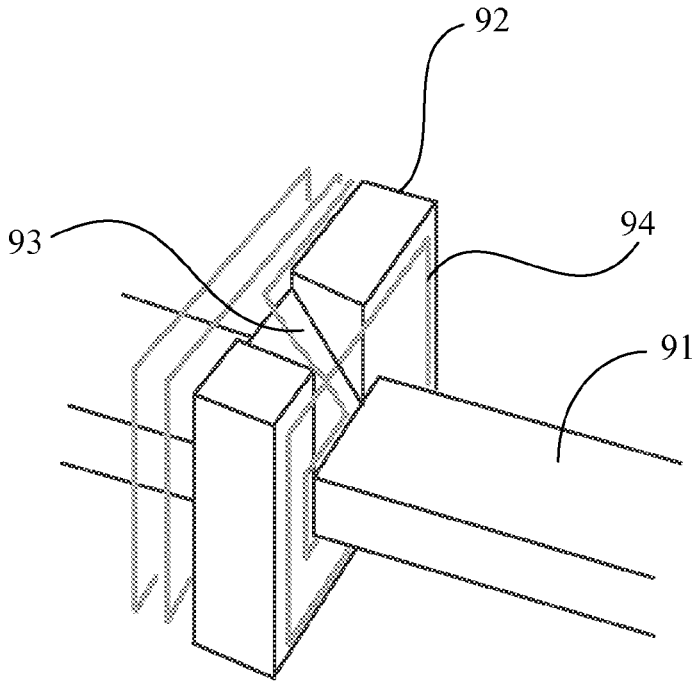
FIG. 9A is a partial view of the high voltage transformer for a backlight power source according to an eighth embodiment of the present invention.
Figure 9B:
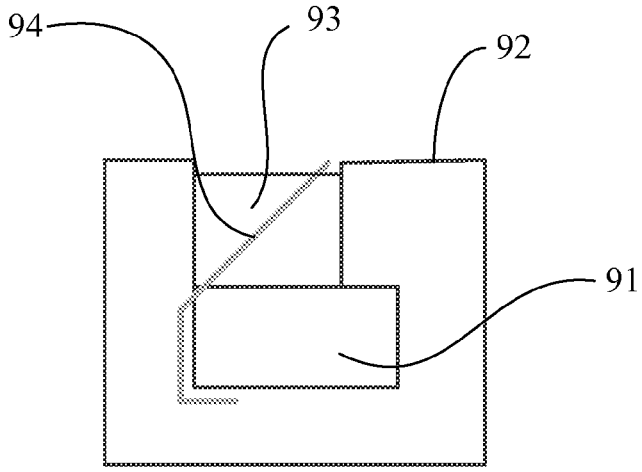
FIG. 9B is a partial side view of the high voltage transformer for a backlight power source according to the eighth embodiment of the present invention.

Referring to FIGS. 9A and 9B, a partial view, partial side view of the high voltage transformer for a backlight power source according to an eighth embodiment of the present invention are illustrated, respectively. As shown, a recess 93 is disposed on an isolating wall 92 having a predetermined thickness but not directly through. In the recess 93, a slanting surface is disposed along a direction of a main shaft body 91 In this case, windings 94 may not cross and contact with each other when being wound from one trough to an adjacent trough through the recess 93.

Figure 10:
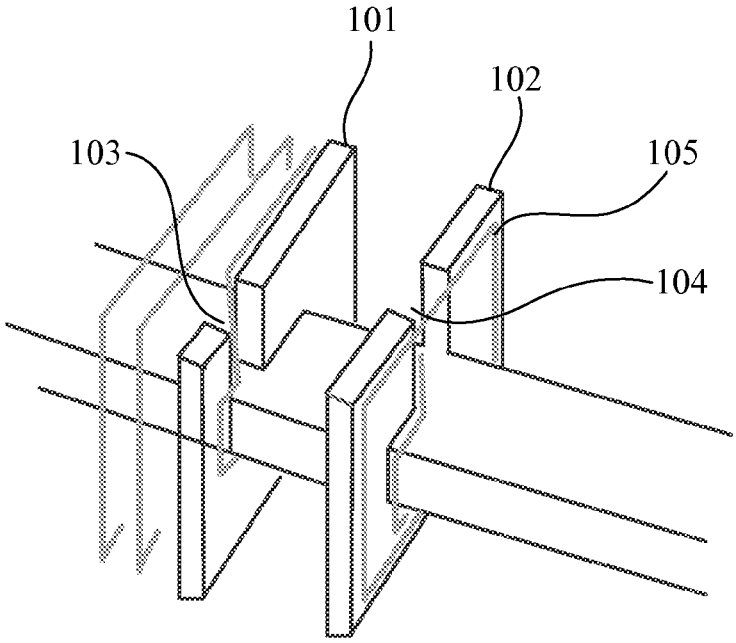
FIG. 10 is a partial view of the high voltage transformer for a backlight power source according to a ninth embodiment of the present invention.

Referring to FIG. 10, a partial view of the high voltage transformer for a backlight power source according to an ninth embodiment of the present invention is illustrated. As shown, two recesses 103,104 are disposed on two isolating walls 101, 102, respectively, of the transformer. The two recesses 103, 104 are disposed along a diagonal direction with respect to the isolating walls 101, 102. In this case, windings 105 may not cross and contact with each other when being wound from one trough to an adjacent trough through the recesses 103, 104.

Figure 11:
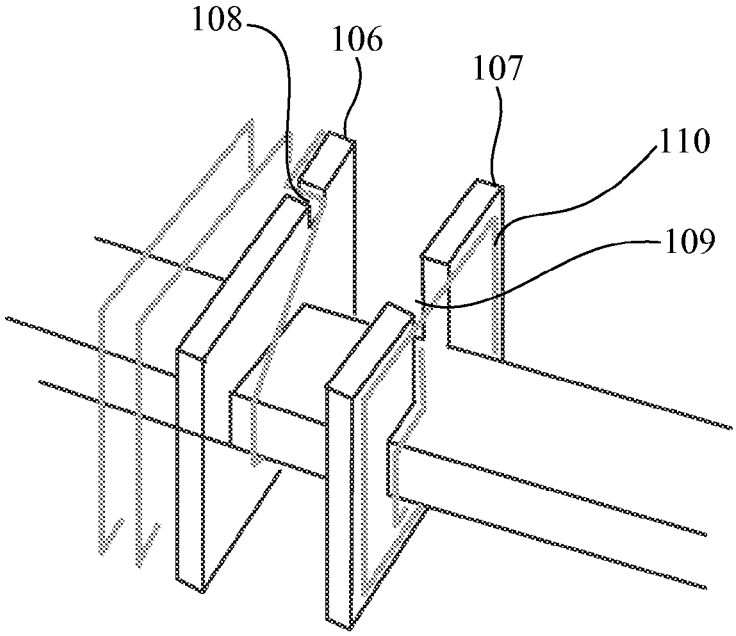
FIG. 11 is a partial view of the high voltage transformer for a backlight power source according to the tenth embodiment of the present invention.

Referring to FIG. 11, a partial view of the high voltage transformer for a backlight power source according to a tenth embodiment of the present invention is illustrated. As shown, two recesses 108, 109 are disposed on a first and second isolating walls 106, 107, respectively, of the transformer. The recess 108 of the first isolating walls 106 is a concave while the recess 109 of the second isolating walls 107 is a fillister. The two recesses 108, 109 are disposed along a diagonal direction with respect to the first and second isolating walls 106, 107. In this case, windings 110 may not cross and contact with each other when being wound from one trough to an adjacent trough through the two recesses 108, 109.

As compared to the prior art, the inventive high voltage transformer for a backlight power source provides the following advantages. 1. With the novel structural designs of the windings base, windings in the high voltage transformer may be wound upward layer by layer on the bottom of the windings trough when the windings are wound across the isolating wall, in prevention of windings of different voltages flown therein crossing and contacting with each other and thus a reduced voltage bearing ability of the transformer. 2. With the novel structural designs of the windings base, the distance generated from stacking of the windings is served to increase the bearing voltage and reduce length of the transformer, enhancing stability of the transformer. 3. The high voltage transformer provides the advantages of prolonged lifetime, lower cost, reduced dimension and space saving of the transformer.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A high voltage transformer for a backlight power source, comprising a windings base, a core and windings, the windings base having an isolating wall disposed exterior thereto through which a first and a second windings troughs are formed, the core disposed within a hollow body of the windings base, and the windings having a first windings wound on the first windings trough and a coil of the windings passing through the isolating wall to have a second windings wound on the second windings trough, wherein the hollow body is engaged with the isolating wall by passing therethrough and the isolating wall is formed a cutout opening to expose the hollow body and a guiding recess is formed at a bottom corner of an inner wall of the cutout opening so that when the first windings trough wound by the first windings is full, the coil passes through the guiding recess to start winding on the second windings trough to complete the second windings.

2. A high voltage transformer for a backlight power source, comprising a windings base, a core and windings, the windings base having an isolating wall disposed exterior thereto through which a first and a second windings troughs are formed, the core disposed within a hollow body of the windings base, and the windings having a first windings wound on the first windings trough and a coil of the windings passing through the isolating wall to have a second windings wound on the second windings trough, wherein the hollow body is engaged with the isolating wall by passing therethrough and the isolating wall is formed a recess disposed at a position deviated from a main shaft body and in which the coil is guided so that when the first windings trough wound by the first windings is full, the coil passes through the guiding recess to start winding on the second windings trough to complete the second windings.

3. The high voltage transformer according to claim 2, wherein the recess has a slanted surface.

4. The high voltage transformer according to claim 2, wherein the recess is a slantedly disposed recess.

5. The high voltage transformer according to claim 2, wherein the isolating walls have a two-sectioned recess.

6. The high voltage transformer according to claim 2, wherein the isolating wall has a predetermined thickness and the recess has a slanting surface disposed along a direction of the main shaft body and is not directly through.

* * * * *